United States Patent [19]

Morell et al.

[11] Patent Number: 4,823,404

[45] Date of Patent: Apr. 25, 1989

[54] TWO PIECE PROTECTIVE GARMENT

[75] Inventors: Lori A. Morell, Alpharetta; Joyce A. Wessel, Acworth, both of Ga.

[73] Assignee: Kimberly-Clark Corporation, Neenah, Wis.

[21] Appl. No.: 205,709

[22] Filed: Jun. 10, 1988

[51] Int. Cl.[4] ..... A41B 1/08; A41D 1/06; A41D 13/02

[52] U.S. Cl. ..... 2/69; 2/DIG. 1; 2/79; 2/82; 2/115; 2/227

[58] Field of Search ..... 2/69, 79, 82, 115, 227, 2/97, 272, DIG. 1, 114

[56] References Cited

U.S. PATENT DOCUMENTS 3,803,640 4/1974 Ericson ..... 2/114
4,117,552 10/1978 Simpson ..... 2/79
4,504,977 3/1985 King et al. ..... 2/114 X
4,504,978 3/1985 Gregory et al. ..... 2/114 X
4,555,811 12/1985 Shimalla ..... 2/114 X

*Primary Examiner*—H. Hampton Hunter
*Attorney, Agent, or Firm*—William D. Herrick

[57] ABSTRACT

A protective garment is described that is particularly suitable for application such as spray painting and the like. The garment includes a top with a "Z" closure front opening and a separate bottom. The front of both the top and bottom is made from a nonwoven having a smooth calendered outer surface and an uncalendered inner body facing surface, and the back of both the top and bottom is made from a breathable material. The result is a very high degree of comfort and protection from contamination, as well as reduced pilling and release of fibers from the garment.

10 Claims, 2 Drawing Sheets

TWO PIECE PROTECTIVE GARMENT

FIELD OF THE INVENTION

The field of the invention relates to protective cover garments such as coveralls and the like. Such garments are useful in applications where contact is likely with dirt, liquids such as paint, or other contaminants that may be difficult to remove or may harm or stain the wearer or garments worn by the wearer under the protective cover garment. It is known to provide coveralls of a disposable or reuseable nature to workers in such environments to protect the worker and the garments worn under the coveralls. For particularly demanding applications such as, for example, spray painting where large quantities of paint or other liquid contaminants may be contacted, it is important that such cover garments be liquid impermeable, at least in front where the contact is likely to occur. Further, where it is necessary to wear such cover garments for extended periods of time the comfort of the wearer is an important consideration since liquid impervious materials tend to be hot and stuffy because of the inability to transmit moisture vapor. Moreover, it will be necessary in many such applications that the protective garment be nonlinting to avoid soiling the freshly-painted surface. The present invention is directed to improvements in such cover garments that result in increased protection as well as comfort.

BACKGROUND OF THE INVENTION

U.S. Pat. Nos. 4,408,357 to Toth dated Oct. 11, 1983 and 4,586,196 to White dated May 6, 1986 relate to disposable surgeon's gowns having back closures and made of material that is liquid repellent or impermeable in the front and porous or breathable in back. U.S. Pat. No. 4,196,245 to Kitson, Gilbert and Israel dated Apr. 1, 1980 is directed to a nonwoven fabric for use in disposable items such as surgical gowns that can be treated for increased liquid repellency and abrasion resistance. U.S. Pat. No. 4,665,563 to Harvey dated May 19, 1987 is directed to a rainproof jacket including a straight collar and a ventilated back panel.

SUMMARY OF THE INVENTION

In accordance with the present invention, there is provided an improved front opening protective garment that includes separate top and bottom parts. The top includes a front opening, neck opening, right and left sleeves and the bottom includes a waist opening, front and back portions, and right and left legs. In accordance with the invention, the front portion of both the top and the bottom are made from a nonwoven having a smooth calendered outer surface and an uncalendered inner body facing surface and the back portions or the top and bottom are made from a breathable material having a Frazier air vapor permeability of at least about 150 cubic feet per minute per ft.$^2$. The front opening includes a "Z" closure without an exposed raw edge. Specific embodiments include those wherein the nonwoven material used for the front portions is a smooth calendered laminate of a spunbonded polypropylene nonwoven and a meltblown polypropylene nonwoven. The back portions preferably are made from a lightweight, breathable spunbonded polypropylene. Other preferred embodiments include a mandarin-type neck opening with adjustable size and elasticized wrist and ankle openings. For improved fit, the waist back portion of the top may be elasticized. Further improvements may be attained by including an internal pocket in the top as well as pocket openings and by making the length of the top sufficient to cover the pocket openings so as to avoid contamination through pocket openings and to prevent gapping between the top and bottom.

DESCRIPTION OF THE PREFERRED EMBODIMENTS

While the invention will be described in connection with preferred embodiments thereof, it will be understood that is not intended to limit the invention to those embodiments. On the contrary, it is intended to cover all alternatives, modifications, and equivalents that may be included within the spirit and scope of the invention as defined by the appended claims.

Figure 1:
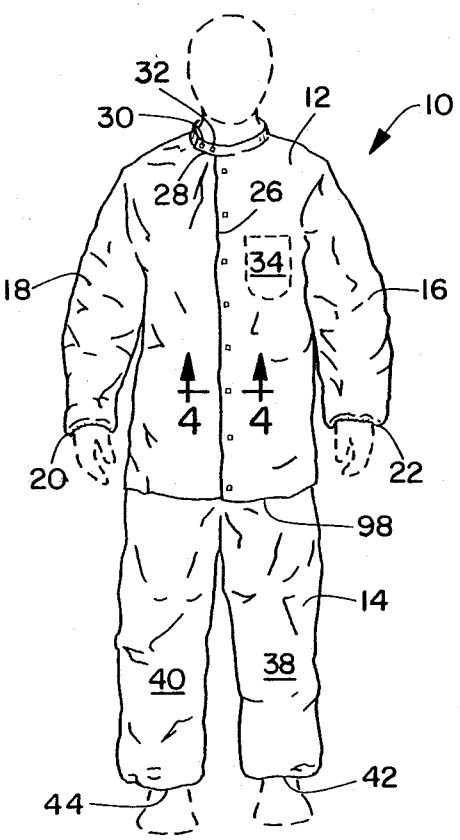
FIG. 1 is a front view of a preferred embodiment of a protective garment of the invention being worn.

Turning to FIG. 1, protective garment 10 is shown from a front view. The garment 10 includes top 12 and bottom 14. Top 12 includes sleeves 16 and 18 with cuffs 20 and 22, collar 24 and front opening 26. Preferably top 12 also includes mandarin collar 28 with adjustable snaps 30 and 32. This provides added security against splashes and spills even when the wearer is wearing a shirt with a collar as the undergarment. If desired, pocket 34 may be included on the inside of the garment as shown in phantom. Bottom 14 includes elasticized waist opening 36 (FIG. 7) as well as leggings 38 and 40 with cuffs 42 and 44.

Figure 2:
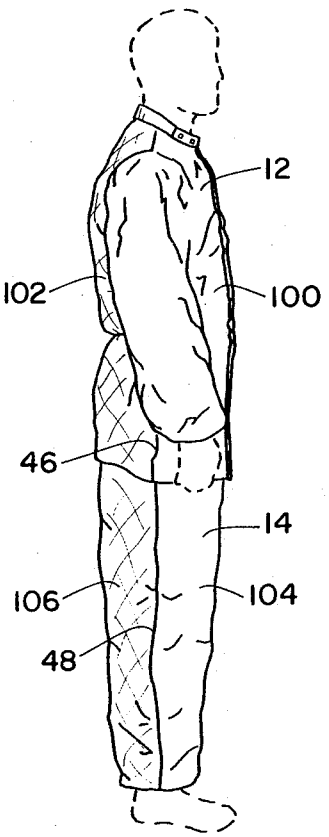
FIG. 2 is a side view of the garment of FIG. 1.

Turning to FIG. 2, a side view is shown illustrating in addition seam 46 between the liquid impervious front 100 and the breathable back 102 of top 12 and seam 48 between the liquid impervious front 104 and the porous back 106 of bottom 14.

Figure 3:
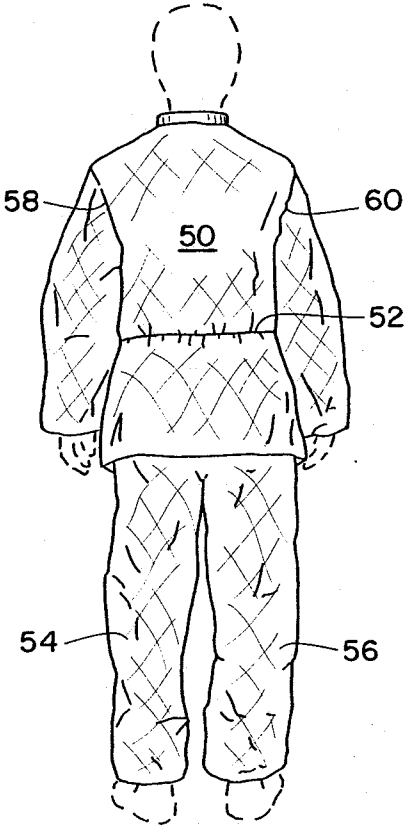
FIG. 3 is a back view of the garment of FIG. 1.

FIG. 3 further illustrates back portion 50 including a preferred elasticized waist portion 52 and the back portions 54 and 56 of the leggings. Preferably, set-in seams 58 and 60 are provided so that the garment has a larger breathable back panel than would result, for example, from the use of raglan sleeves.

Figure 4:
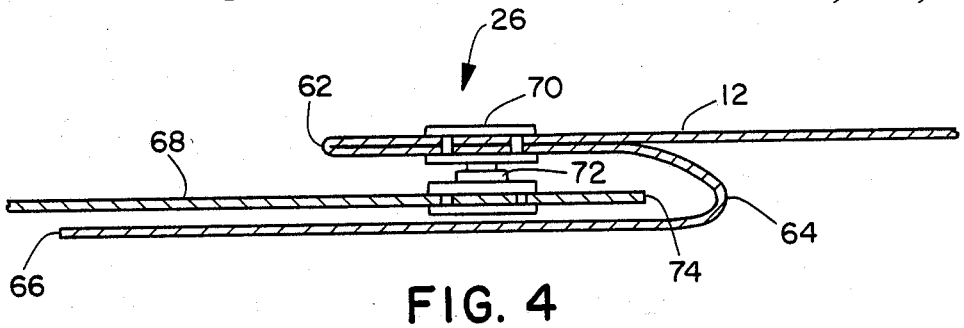
FIG. 4 is a cross-section of the "Z" closure of the top taken along lines for 4—4 of FIG. 1.

Turning to FIG. 4, the preferred embodiment of obtaining a "Z" folded front closure is illustrated. As shown in cross-section taken along lines 4—4 of FIG. 1, the edge of the left panel of top 12 is "Z" folded at folds 62 and 64 so that the edge 66 underlies the other front panel 68. The male part 70 of a snap fastener is attached to the first folded portion and mates with the female portion of the fastener 72 on panel 68 so that edge 74 is also covered. In this manner, no free edges are exposed, and a high degree of sealing against liquid penetration is obtained along the line of front closure 26. While snaps are shown, other fastening devices can be used that are consistent with the "Z" fold. Snaps, however, are preferred because they may be non-scratching and non-sparking, which is particularly important where solvents are present, for example.

Figure 5:
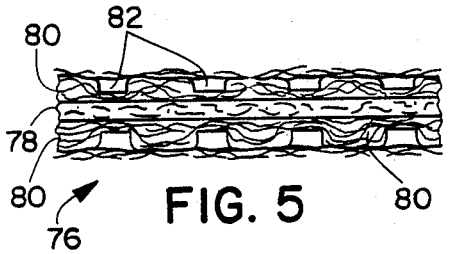
FIG. 5 is a cross-section of a fabric useful for forming the front of the garment of the present invention.

Turning to FIG. 5, a preferred base material for use as the front portions of the garment of the present invention is illustrated. As shown, web 76 includes meltblown layer 78 which provides a high degree of imperviousness, and on both sides of layer 78 is provided a spunbond layer 80 as strength bearing members. The layers are interbonded by means of a pattern application of heat and pressure in bond areas 82. Such webs and their manufacture are described, for example, in U.S. Pat. No. 4,041,203 to Brock and Meitner dated Aug. 9, 1977 which is incorporated herein by reference.

Figure 6:
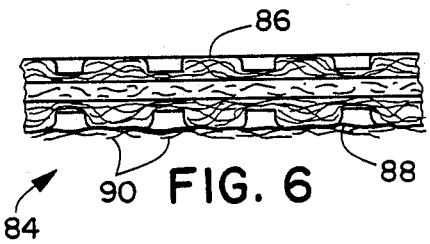
FIG. 6 illustrates the fabric of FIG. 5 after calendering one surface only.
Figure 8:
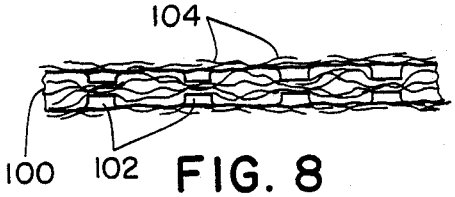
FIG. 8 is a cross-section of a fabric useful for forming the back of the garment of the present invention.
Figure 9:
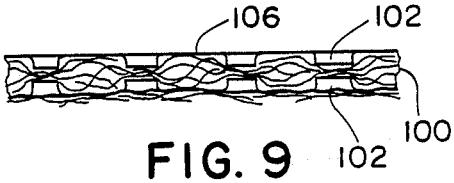
FIG. 9 illustrates the web of FIG. 8 after calendering one surface only.

Turning to FIG. 6, a further preferred embodiment is shown illustrating the web of FIG. 5 that has received additional calendering on one side only. By "calendered" it is intended to include these surfaces that have an abrasion resistance of at least about 2500 cycles as measured using 1.7 psi on a Martindale Abrasion Tester Model No. 103 according to British Standard No. 5690:1979. As shown, embossed web 84 has surface 86 that presents a smooth, impervious barrier whereas opposite surface 88 which is uncalendered includes fiberals 90 which are intended to contact the wearer and provide a comfortable feel. Such webs may be obtained by treating a laminate obtained as described in the above referenced Brock and Meitner U.S. Pat. No. 4,041,203 and further in accord with coassigned U.S. patent application Ser. No. 07/130,366 to Maddern and Currie. Preferred webs useful in accordance with the present invention will be a combination of meltblown polypropylene microfiber webs having a basis weight in the range of from about 0.4 ounces per yd$^2$ (13.6 gsm) to 0.7 ounces per yd$^2$ (23.7 gsm) with spunbonded continuous filament polypropylene webs having a basis weight in the range from about 1.2 to (40.7 gsm) to 1.6 ounces per yd$^2$ (54.3 gsm) for the front panel and 1.0 osy (33.9 gsm) to 1.4 osy (47.5 gsm) for the back panel and bonded by a patterned application of heat and pressure with temperatures in the range of about 330° F. (165.6° C.) to 345° F. (174° C.) and a pattern of from about 16,750 to 31,620 bonds per square meter and bonded area in the range from about 25% to 30% of the surface area. FIGS. 8 and 9 similarly illustrate webs useful for the breathable back material. As shown, web 100 is a porous nonwoven bonded by a patterned application of heat and pressure in bond areas 102. Although the individual filaments 104 may be continuous, portions will be exposed outside the bond areas. In a preferred embodiment shown in FIG. 9, the web is calendered on side 106 presenting a smooth surface that is particularly low linting.

Figure 7:
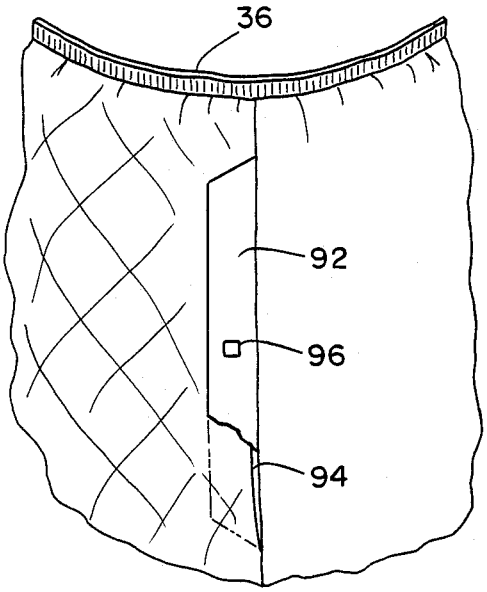
FIG. 7 illustrates a preferred pocket cover embodiment of the garment of the present invention.

Turning to FIG. 7, a preferred embodiment of pocket access openings will be described. As shown, the preferred embodiment includes flap 92 shown partially broken away and which covers an opening 94. Snap fastener 96 may be used to maintain the closure when desired. Thus, this further means provides additional security against contamination particularly when used in combination with the extra length top (FIG. 1) with bottom length 98 that extends below the pocket opening 94.

Manufacture of the garment of the present invention may be accomplished by known cutting, sewing, and bonding steps. Preferably, however, for economy, the seams may be formed by ultrasonic seaming, adhesives, or heat sealing, and the garment assembled in the following manner: the elastic is first sewn into the back panel and the front and back panels attached at the shoulder seams. Next the sleeves are sewn in and the side panels sewn. The "Z" front closure preferably is then formed and collar and snaps attached. The waist elastic is attached next. Sewing the pants occurs by first sewing inseams, then sides and adding pocket tabs. Finally, the waist and cuff elastic is sewn in.

EXAMPLE

The following components were assembled to construct the garment in accordance with FIG. 1: Base material for the front was a layer of 0.6 ounces/yd$^2$ (20.3 gsm) meltblown polypropylene between two layers of 0.6 ounces/yd$^2$ (20.3 gsm) spunbonded polypropylene for a total basis weight of 1.8 ounces/yd$^2$ (61 gsm). The combination was pattern bonded by application of heat and pressure in a diamond pattern as illustrated in U.S. Pat. No. 4,041,203 to Brock and Meitner of 31,620 bonds per M$^2$ and over 27% of the surface area. The combination was calendered at a temperature of 335° F. and pressure of 50 psi on one side only as described in above referenced U.S. Ser. No. 07/130,366 to Maddern and Currie. The material for the back was 1.2 ounces/yd$^2$ (40.7 gsm) spunbonded polypropylene having a Frazier air vapor permeability of 150 gsm. The garment top and bottom were assembled as described above.

The garment of Example 1 and a conventional coverall painting garment available under the Molnlycke trademark were subjected to simulated use conditions in a spray painting operation by placing garments over a corrugated box to represent a torso and to keep the material smoothly in place. A blotter was weighed and placed under the garment to absorb any paint that may pass through.

Paint was sprayed on the garment from approximately 10"–12" away for 10 seconds and then the garment with paint was allowed to "rest" for 10 minutes. After the 10 minutes, the inside was checked visually for any strike-through of paint both by checking the blotter and looking at the inside of the garment fabric.

While the paint did not reach the blotter, partial running of the paint and also paint coming through the back panel and the zipper seam were observed with the conventional garment. Also the paint on the zipper area caused some difficulty in the opening of the zipper.

The two-piece garment's "Z" front closure in accordance with the invention not only prevents any paint from passing through, but was also easier to open when removing the garment. The front heavily calendered panel material and the lightly calendered back panel material prevented the paint from penetrating.

In addition, the two piece construction of the garment of the present invention has been found by wearers to be more comfortable than conventional coveralls particularly where a wide range of movement is needed. Further, the ability to change only a soiled top or bottom and to combine different sizes is highly convenient. Moreover, the abrasion resistant nature of the outer surface results in reduced incidences of contamination by pilling or release of fibers from the garment itself.

Thus, it is apparent that there has been provided, in accordance with the invention, an improved cover garment for wearer protection and reduced contamination that fully satisfies the objectives, aims and advantages set forth above. While the invention has been described in conjunction with specific embodiments, thereof, it is evident that many alternatives, modifications and variations will be apparent to those skilled in the art and by the foregoing description. Accordingly, it is intended to embrace all such alternatives, modifications, and variations as are included in the spirit and broad scope of the appended claims.

We claim:

1. In a protective garment including a front opening top having a front portion, back portion, neck opening, right and left sleeves and a bottom having a front portion, back portion, waist opening, right and left legs, the improvement wherein said top and bottom front portions are made from a nonwoven having a smooth calendered outer surface and an uncalendered inner body facing surface and said top and bottom back portions are made from a breathable material having a Frazier air vapor permeability of at least about 150 $ft^3$ per minute per $ft.^2$ and wherein said front opening includes a "Z" closure without exposed raw edges.

2. The protective garment of claim 1 wherein the front portions are made from a laminate of continuous filament and microfiber nonwovens.

3. The protective garment of claim 2 wherein the back portions are made from a continuous filament nonwoven.

4. The protective garment of claim 3 wherein the nonwovens are each polypropylene.

5. The protective garment of claim 1 further including a mandarin neck opening.

6. The protective garment of claim 5 wherein the neck opening is adjustable.

7. The protective garment of claim 1 wherein the bottom has elasticized waist and ankles and the top has elasticized cuffs.

8. The protective garment of claim 7 wherein the top includes an internal pocket.

9. The protective garment of claim 7 wherein the top has an extended length and is adapted to avoid gapping between the top and bottom under use conditions.

10. The protective garment of claim 7 wherein snaps are provided for the front closure and the sleeve seams are set-in.

* * * * *

UNITED STATES PATENT AND TRADEMARK OFFICE

CERTIFICATE OF CORRECTION

PATENT NO. : 4,823,404

DATED : April 25, 1989

INVENTOR(S) : Lori A. Morell, Joyce A. Wessel

It is certified that error appears in the above—identified patent and that said Letters Patent is hereby corrected as shown below:

Column 3, Line 33 "07/130,366" should read "07/130,386"

Column 4, Line 26, "07/130,366" should read "07/130,386"

In the Abstract - Line 2, "application" should read "applications"

Column 1, Line 56 "or the top" should read "of the top"

Signed and Sealed this

Twenty-seventh Day of March, 1990

*Attest:*

JEFFREY M. SAMUELS

*Attesting Officer*

*Acting Commissioner of Patents and Trademarks*